US012440025B2

(12) United States Patent
Chen et al.

(10) Patent No.: US 12,440,025 B2
(45) Date of Patent: Oct. 14, 2025

(54) SLIDE RAIL MECHANISM AND SLIDE RAIL ASSEMBLY THEREOF

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Shun-Ho Yang, Kaohsiung (TW); Kai-Wen Yu, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 259 days.

(21) Appl. No.: 18/307,955

(22) Filed: Apr. 27, 2023

(65) Prior Publication Data

US 2024/0188715 A1 Jun. 13, 2024

(30) Foreign Application Priority Data

Dec. 9, 2022 (TW) ..... 111147682

(51) Int. Cl.
*A47B 88/49* (2017.01)
*A47B 88/423* (2017.01)

(52) U.S. Cl.
CPC ..... *A47B 88/49* (2017.01); *A47B 88/423* (2017.01)

(58) Field of Classification Search
CPC ..... A47B 88/49; A47B 88/423; A47B 2210/0016; A47B 2088/4235; A47B 88/43; A47B 2095/022; A47B 2210/0018; A47B 88/57; A47B 2095/021; A47B 95/02; E05B 65/46; H05K 5/023
See application file for complete search history.

(56) References Cited

U.S. PATENT DOCUMENTS

| | | | | |
|---|---|---|---|---|
| 5,033,805 | A * | 7/1991 | Hobbs | A47B 88/493 312/334.46 |
| 5,292,191 | A * | 3/1994 | Slivon | A47B 88/944 292/128 |
| 5,417,490 | A * | 5/1995 | Hobbs | A47B 88/42 312/334.32 |
| 6,412,891 | B1 * | 7/2002 | Liang | A47B 88/487 312/334.44 |
| 10,004,331 | B2 | 6/2018 | Jeffries et al. | |
| 10,172,452 | B2 * | 1/2019 | Hanley | A47B 88/50 |

(Continued)

FOREIGN PATENT DOCUMENTS

WO WO2021146355 A1 7/2021

*Primary Examiner* — Hiwot E Tefera
(74) *Attorney, Agent, or Firm* — Best & Flanagan LLP

(57) ABSTRACT

A slide rail mechanism includes a first slide rail assembly, a second slide rail assembly and an unlocking handle. Each of the slide rail assemblies comprises a first rail, a second rail and a locking member. The first rail and the second rail are movable relative to each other. The locking member is configured to lock the second rail relative to the first rail at a predetermined position. The locking handle is movably mounted between the first slide rail assembly and the second slide rail assembly. When the unlocking handle is moved from a first position to a second position, the unlocking handle is configured to drive the locking member to move in order to unlock the second rail relative to the first rail at the predetermined position.

18 Claims, 8 Drawing Sheets

(56) References Cited

U.S. PATENT DOCUMENTS

| | | | | |
|---|---|---|---|---|
| 10,443,271 | B1 * | 10/2019 | Rose | E05C 3/16 |
| 2006/0158071 | A1 * | 7/2006 | Muller | A47B 95/02 312/234.5 |
| 2009/0102333 | A1 * | 4/2009 | Weng | E05B 65/462 292/300 |
| 2011/0121701 | A1 * | 5/2011 | Chang | E05B 7/00 312/332.1 |
| 2011/0169389 | A1 * | 7/2011 | Jeffries | A47B 95/02 292/336.3 |
| 2011/0291539 | A1 * | 12/2011 | Leal | A47B 88/493 312/334.44 |
| 2014/0354001 | A1 * | 12/2014 | Hanley | A47B 57/10 296/24.44 |
| 2015/0145383 | A1 * | 5/2015 | Grela | A47B 81/00 312/215 |
| 2019/0231071 | A1 | 8/2019 | Smith | |
| 2019/0298060 | A1 * | 10/2019 | Chen | A47B 88/483 |
| 2019/0352938 | A1 | 11/2019 | Sonney | |
| 2021/0212463 | A1 * | 7/2021 | Milligan | A47B 95/02 |
| 2022/0312959 | A1 | 10/2022 | Hanley et al. | |
| 2023/0024568 | A1 * | 1/2023 | Chen | H05K 5/023 |
| 2023/0127240 | A1 * | 4/2023 | Hadav | H05K 7/1487 16/415 |

* cited by examiner

SLIDE RAIL MECHANISM AND SLIDE RAIL ASSEMBLY THEREOF

BACKGROUND OF THE INVENTION

1. Field of the Invention

The present invention relates to a slide rail mechanism, and more particularly, to a slide rail mechanism having an unlocking handle.

2. Description of the Prior Art

Patent number WO 2021/146355A1 discloses a rotational bar for drawer slide latch operation. A drawer slide comprises an outer member (such as an outer rail) and an inner member (such as an inner rail) movable relative to each other. A release leaver is pivotally mounted to the inner member, and the release lever has a tab for being engaged with a predetermined catch of the outer member, such that the inner member is held in a position relative to the outer member. An arm is connected to an end of a rotating bar, and the arm is positioned to engage the release lever. According to such arrangement, when a user applies a force to the rotating bar, the rotating bar is configured to drive the arm to unlock the tab of the release lever from the catch of the outer member.

U.S. Pat. No. 10,004,331 B2 discloses a drawer release mechanism, which comprises a handle extrusion. A side of the handle extrusion is provided with a first pin (or a second pin) which is engaged with a lever. The lever is pivotally mounted to an inner rail. When a user applies a force to the handle extrusion, the handle extrusion is configured to drive the first pin to move the lever, so as to unlock the inner rail from the outer rail.

The rotating bar and the handle extrusion respectively disclosed in the aforementioned two patents are configured to rotate when the user applies the force. However, there is no change in height when the rotating bar and the handle extrusion are rotated relative to the slide rail (or the drawer). In addition, the rotating bar is engaged with the release lever; similarly, the handle extrusion is also engaged with the lever through the first pin.

However, in order to meet diverse requirements of the market, sometimes it is not desirable to unlock the rail through the arrangement disclosed in the aforementioned patents. Therefore, it is important to develop various products.

SUMMARY OF THE INVENTION

The present invention relates to a slide rail mechanism having an unlocking handle, and a slide rail assembly thereof.

According to an embodiment of the present invention, a slide rail mechanism comprises a first slide rail assembly, a second slide rail assembly and an unlocking handle. Each of the first and second slide rail assemblies comprises a first rail, a second rail and a locking member. The first rail and the second rail are movable relative to each other. The locking member is configured to lock the second rail relative to the first rail at a predetermined position. The unlocking handle is movably mounted between the first slide rail assembly and the second slide rail assembly. When the unlocking handle is moved from a first position to a second position, the unlocking handle is configured to drive the locking member to move in order to unlock the second rail relative to the first rail at the predetermined position.

Preferably, the unlocking handle is movably mounted between the second rail of the first slide rail assembly and the second rail of the second slide rail assembly.

Preferably, the unlocking handle is movably mounted on a carried object mounted between the second rail of the first slide rail assembly and the second rail of the second slide rail assembly.

Preferably, the unlocking handle is detachably connected between the second rail of the first slide rail assembly and the second rail of the second slide rail assembly.

Preferably, the unlocking handle comprises two working members and a linkage rod. The linkage rod is arranged between the two working members. The two working members are rotatably connected to the second rail of the first slide rail assembly and the second rail of the second slide rail assembly respectively.

Preferably, each of the working members comprises a first part and a second part. A predetermined distance is defined between the first part and the second part. The first part is pivotally connected to the second rail through a connecting member. The linkage rod is connected to the second part.

Preferably, each of the working members is arranged with a first limiting feature, and each of the second rails is arranged with a second limiting feature. The two working members are configured to rotate within a limited range through interaction between the first limiting feature and the second limiting feature.

Preferably, each of the first and second slide rail assemblies further comprises an operating member. When a force is applied to the linkage rod of the unlocking handle, each of the working members of the unlocking handle is rotated from the first position to the second position in order to drive the locking member to move through the operating member.

Preferably, the operating member is linearly movable relative to the second rail.

Preferably, when the unlocking handle is located at the first position, the linkage rod of the unlocking handle is located at a first height relative to each of the first and second slide rail assemblies. When the unlocking handle is located at the second position, the linkage rod of the unlocking handle is located at a second height different from the first height relative to each of the first and second slide rail assemblies.

Preferably, the unlocking handle is configured to be linearly moved from the first position to the second position.

According another embodiment of the present invention, a slide rail assembly comprises a first rail, a second rail, a locking member and an unlocking handle. The second rail is movable relative to the first rail. The locking member is configured to lock the second rail relative to the first rail at a retracted position. The unlocking handle is movable relative to the second rail. When the unlocking handle is moved from a first position to a second position, the unlocking handle is configured to drive the locking member to move in order to unlock the second rail relative to the first rail at the retracted position, such that the second rail is able to move away from the retracted position.

Preferably, the unlocking handle is detachably connected to the second rail.

Preferably, the unlocking handle comprises a working member and a linkage rod. The linkage rod is arranged on the working member. The working member is rotatably connected to the second rail.

Preferably, the working member comprises a first part and a second part. A predetermined distance is defined between the first part and the second part. The first part is pivotally connected to the second rail through a connecting member. The linkage rod is connected to the second part.

Preferably, the working member is arranged with a first limiting feature, and the second rail is arranged with a second limiting feature. The working member is configured to rotate within a limited range through interaction between the first limiting feature and the second limiting feature.

Preferably, the slide rail assembly further comprises an operating member. When a force is applied to the linkage rod of the unlocking handle, the working member of the unlocking handle is rotated from the first position to the second position in order to drive the locking member to move through the operating member.

Preferably, the operating member is linearly movable relative to the second rail.

Preferably, when the unlocking handle is located at the first position, the linkage rod of the unlocking handle is located at a first height relative to the slide rail assembly. When the unlocking handle is located at the second position, the linkage rod of the unlocking handle is located at a second height different from the first height relative to the slide rail assembly.

Preferably, the unlocking handle is configured to be linearly moved from the first position to the second position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
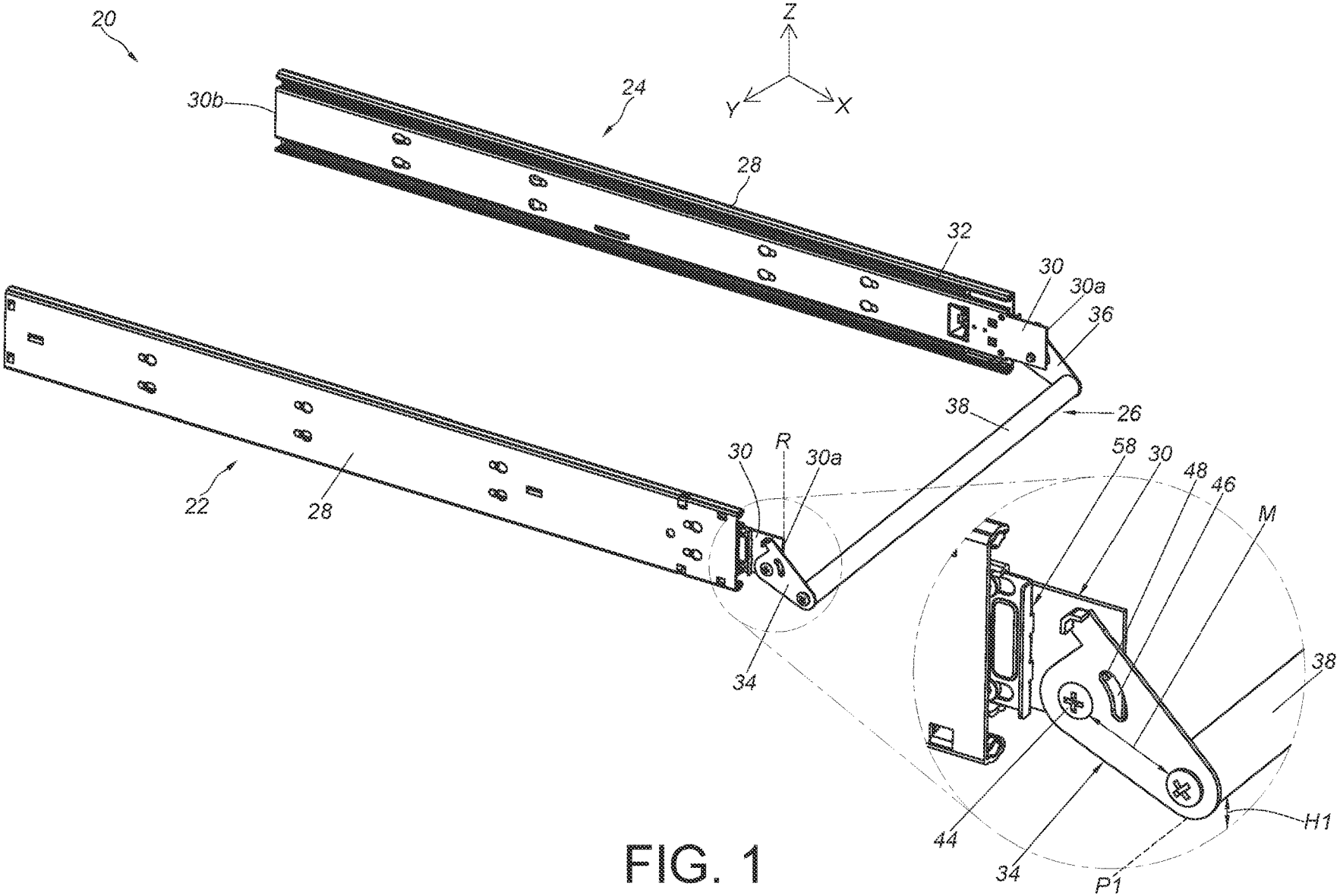
FIG. 1 is a diagram showing slide rail assemblies of a slide rail mechanism being in a retracted state with an unlocking handle being located at a first position according to a first embodiment of the present invention.
Figure 2:
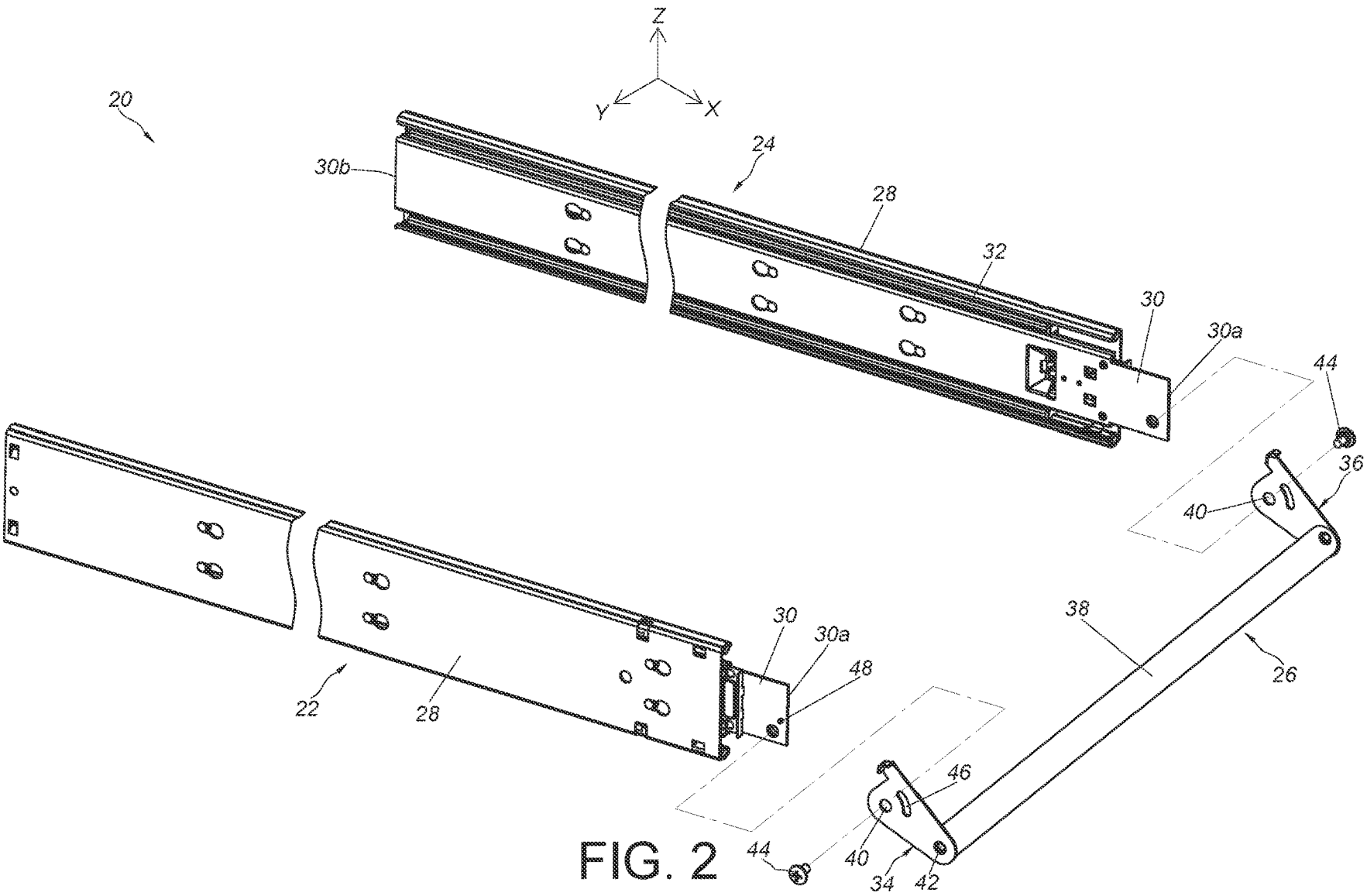
FIG. 2 is an exploded view of the slide rail mechanism according to the first embodiment of the present invention.
Figure 3:
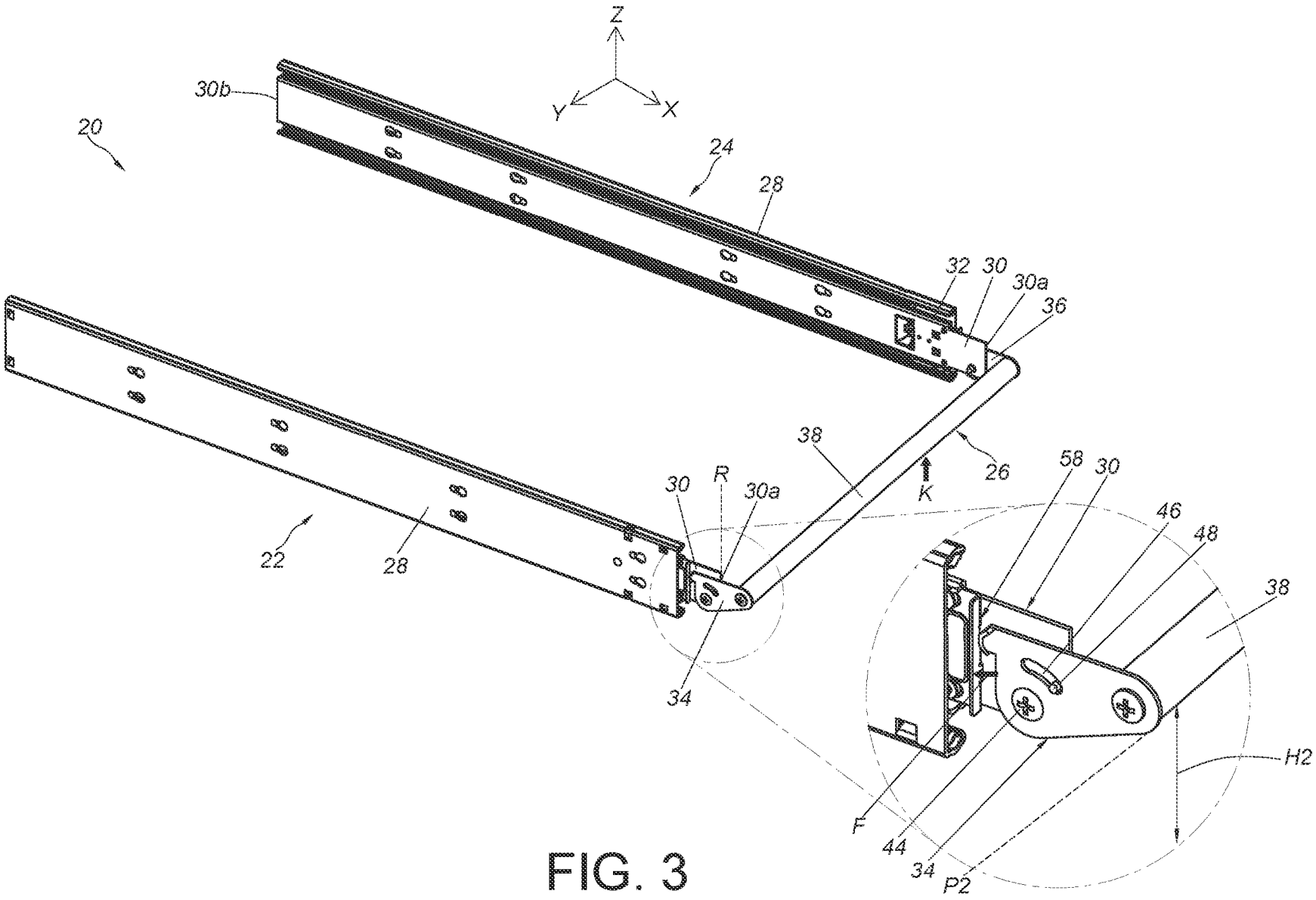
FIG. 3 is a diagram showing the slide rail mechanism with the unlocking handle being located at a second position according to the first embodiment of the present invention.

As shown in FIG. 1, FIG. 2 and FIG. 3, a slide rail mechanism 20 comprises a first slide rail assembly 22, a second slide rail assembly 24 and an unlocking handle 26 according to a first embodiment of the present invention. The first slide rail assembly 22 and the second slide rail assembly 24 have substantially identical structural configuration. Each of the slide rail assemblies 22, 24 comprises a first rail 28 and a second rail 30. The first rail 28 and the second rail 30 are longitudinally movable relative to each other, and the second rail 30 can be located relative to the first rail 28 at a predetermined position R (such as a retracted position, but the present invention is not limited thereto). In the present embodiment, the X-axis is a longitudinal direction (or a length direction of the slide rail), the Y-axis is a transverse direction (or a lateral direction of the slide rail), and the Z-axis is a vertical direction (or a height direction of the slide rail).

Preferably, the first rail 28 is configured to be fixed to a rack or a cabinet (not shown in figures), and the second rail 30 is configured to carry a carried object (not shown in figures).

Preferably, each of the slide rail assemblies 22, 24 further comprises a third rail 32 movably mounted between the first rail 28 and the second rail 30 and configured to extend an opening traveling distance of the second rail 30 relative to the first rail 28.

The unlocking handle 26 is movably mounted between the first slide rail assembly 22 and the second slide rail assembly 24. For example, the unlocking handle 26 is movable from a first position P1 (as shown in FIG. 1) to a second position P2 (as shown in FIG. 3). In the present embodiment, the unlocking handle 26 is movably mounted between the second rail 30 of the first slide rail assembly 22 and the second rail 30 of the second slide rail assembly 24, such that the unlocking handle 26 is movable relative to the second rail 30 of the first slide rail assembly 22 and the second rail 30 of the second slide rail assembly 24.

Preferably, each of the second rails 30 has a front part 30*a* and a rear part 30*b*, and the unlocking handle 26 is arranged adjacent to the front parts 30*a* of the two second rails 30.

Preferably, the unlocking handle 26 comprises two working members (such as a first working member 34 and a second working member 36) and a linkage rod 38. The two working members 34, 36 have substantially identical structural configuration. The linkage rod 38 is arranged between the two working members 34, 36. The two working members 34, 36 are rotatably connected to the second rail 30 of the first slide rail assembly 22 and the second rail 30 of the second slide rail assembly 24 respectively. For example, a user can apply a force K along a predetermined direction (such as an upward direction) to the linkage rod 38 of the unlocking handle 26, such that the two working members 34, 36 of the unlocking handle 26 are rotated to move from the first position P1 (as shown in FIG. 1) to the second position P2 (as shown in FIG. 3).

Preferably, when the unlocking handle 26 is located at the first position P1, the linkage rod 38 of the unlocking handle 26 is at a first height H1 relative to each of the slide rail assemblies 22, 24 (as shown in FIG. 1). When the unlocking handle 26 is located at the second position P2, the linkage rod 38 of the unlocking handle 26 is at a second height H2 relative to each of the slide rail assemblies 22, 24 (as shown in FIG. 3). The second height H2 is different from the first height H1. For example, the second height H2 is higher than the first height H1. In other words, when the unlocking handle 26 is operated, the linkage rod 38 of the unlocking handle 26 is moved to be at different heights relative to each of the slide rail assemblies 22, 24.

Preferably, each of the working members 34, 36 (such as the first working member 34) comprises a first part 40 and a second part 42 (as shown in FIG. 2). A predetermined distance M is defined between the first part 40 and the second part 42 (as shown in FIG. 1). The first part 40 is pivotally connected to the second rail 30 through a connecting member 44. The linkage rod 38 is connected to the second part 42.

Preferably, the unlocking handle 26 is detachably connected between the second rail 30 of the first slide rail assembly 22 and the second rail 30 of the second slide rail assembly 24. For example, the connecting member 44 can be a screw, a bolt or the like, but the present invention is not limited thereto. In other words, the unlocking handle 26 can be detachably connected between the second rail 30 of the first slide rail assembly 22 and the second rail 30 of the second slide rail assembly 24 through the connecting member 44.

Preferably, each of the working members 34, 36 (such as the first working member 34) is arranged with a first limiting feature 46, and each of the second rails 30 (such as the second rail 30 of first slide rail assembly 22) is arranged with a second limiting feature 48. The two working members 34, 36 are configured to rotate within a limited range through interaction between the first limiting feature 46 and the second limiting feature 48. For example, one of the first limiting feature 46 and the second limiting feature 48 is an arc hole (or an arc slot), and the other one of the first limiting feature 46 and the second limiting feature 48 is a protrusion part extended into a portion of the arc hole (or the arc slot), but the present invention is not limited thereto.

Figure 4:
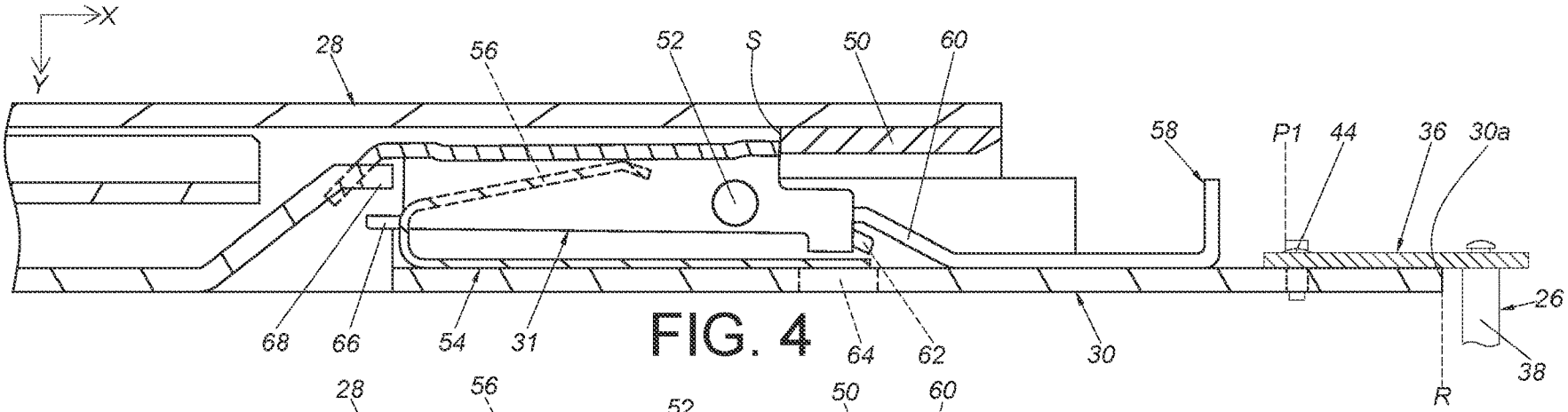
FIG. 4 is a diagram showing a second rail of the slide rail assembly being locked relative to a first rail at a predetermined position with the unlocking handle being located at the first position according to the first embodiment of the present invention.

As shown in FIG. 4, each of the slide rail assemblies (the first slide rail assembly 22 and the second slide rail assembly 24) further comprises a locking member 31 configured to lock the second rail 30 relative to the first rail 28 at the predetermined position R.

Preferably, the locking member 31 is configured to block one edge S of a blocking structure 50 of the first rail 28. In the present embodiment, the blocking structure 50 is a protruded structure. However, in other alternative embodiments, the blocking structure 50 can be a recessed (or hole) structure, but the present invention is not limited thereto. Furthermore, the locking member 31 is movably mounted to the second rail 30. For example, the locking member 31 is pivotally connected to the second rail 30 through a shaft member 52.

Preferably, each of the slide rail assemblies (the first slide rail assembly 22 and the second slide rail assembly 24) further comprises an elastic member 54 attached to the second rail 30. The elastic member 54 comprises an elastic part 56 configured to provide an elastic force to the locking member 31, such that the locking member 31 can be held in a state of blocking the blocking structure 50 of the first rail 28.

Preferably, each of the slide rail assemblies 22, 24 further comprises an operating member 58 movably mounted to the second rail 30. For example, the operating member 58 is linearly movable relative to the second rail 30. A linearly moving direction of the operating member 58 is identical to a moving direction (such as a longitudinal direction) of the second rail 30.

Figure 5:
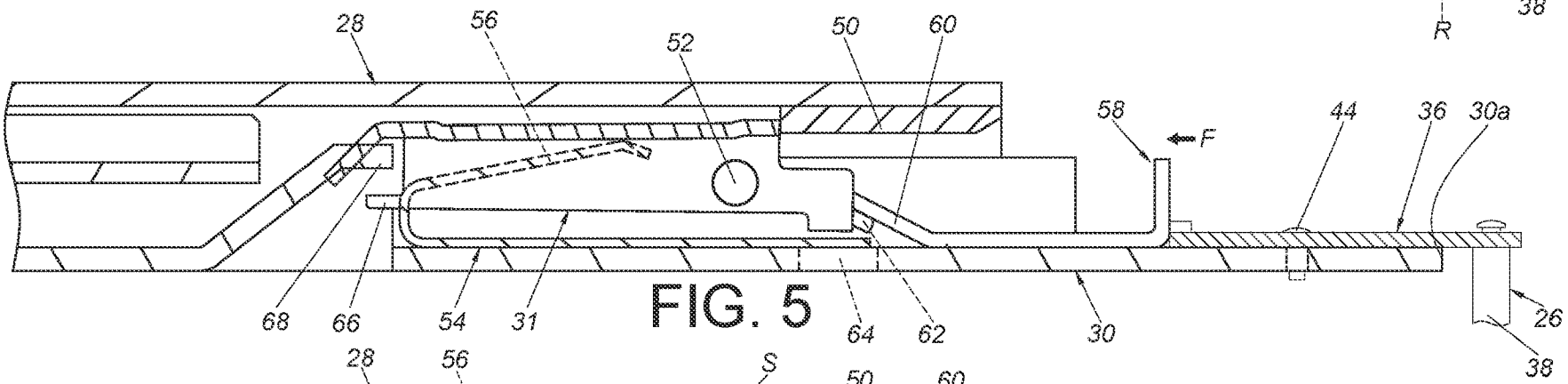
FIG. 5 is a diagram showing the second rail of the slide rail assembly being locked relative to the first rail at the predetermined position with the unlocking handle being operated according to the first embodiment of the present invention.
Figure 6:
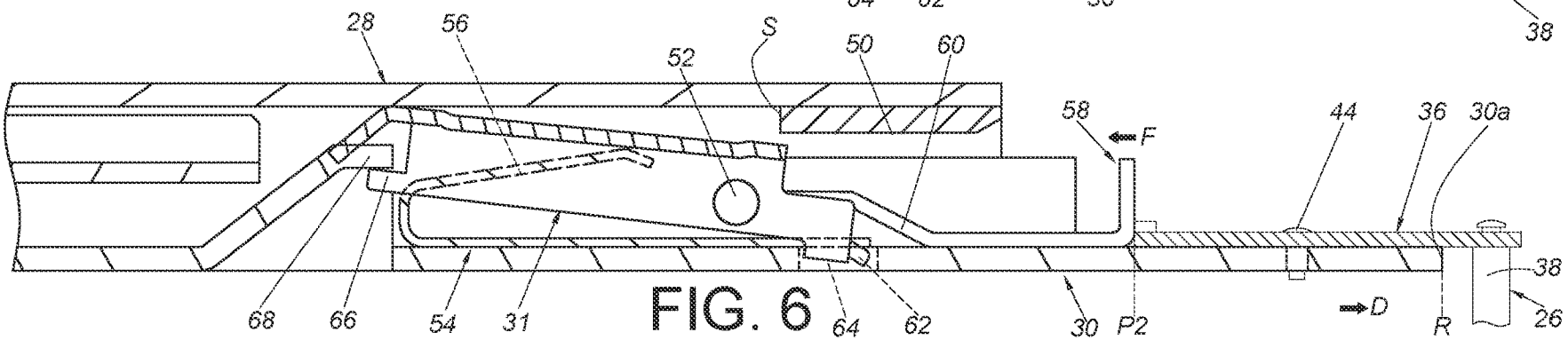
FIG. 6 is a diagram showing the unlocking handle being located at the second position to unlock the second rail relative to the first rail of the slide rail assembly according to the first embodiment of the present invention.

As shown in FIG. 4, FIG. 5 and FIG. 6, when the unlocking handle 26 is moved from the first position P1 (as shown in FIG. 4) to the second position P2 (as shown in FIG. 6), the unlocking handle 26 is configured to drive the locking member 31 to move in order to unlock the second rail 30 relative to the first rail 28 at the predetermined location R (as shown in FIG. 6), such that the second rail 30 can be moved away from the predetermined location R.

Furthermore, when the user applies the force K to the unlocking handle 26, each of the working members 34, 36 (such as the second working member 36) of the unlocking handle 26 is rotated and moved from the first position P1 (as shown in FIG. 4) to the second position P2 (as shown in FIG. 6) by the force K, such that each of the working members 34, 36 (such as the second working member 36) is configured to drive the locking member 31 to move through the operating member 58 in order to unlock the second rail 30 relative to the first rail 28 at the predetermined location R. For example, when the user applies the force K to the linkage rod 38 of the unlocking handle 26, the two working members 34, 36 of the unlocking handle 26 are rotated around the connecting member 44 as a rotational axis to be moved from the first position P1 (as shown in FIG. 4 and FIG. 1) to the second position P2 (as shown in FIG. 6 and FIG. 3), such that each of the two working members 34, 36 generates a driving force F to drive the operating member 58 to move linearly. A first feature 60 of the operating member 58 is configured to be in contact with a second feature 62 of the locking member 31 (such as a contact between two inclined portions as shown in FIG. 5, or a contact between an inclined portion and an arc portion, or a contact between two arc portions), such that the operating member 58 can easily drive the locking member 31 to deflect an angle, in order to disengage the locking member 31 from the edge S of the blocking structure 50 of the first rail 28 (as shown in FIG. 6), so as to allow the second rail 30 to move relative to the first rail 28 along a direction D (such as an opening direction). When the locking member 31 is operated to deflect the angle, the elastic part 56 of the elastic member 54 is elastically bent to be in a state of accumulating an elastic force (as shown in FIG. 6), and the second feature 62 of the locking member 31 is moved toward a hole 64 of the second rail 30. Moreover, when the locking member 31 is driven to deflect the angle, a shoulder part 66 of the locking member 31 is configured to abut against a limiting part 68 of the second rail 24 (as shown in FIG. 6).

Moreover, in other alternative embodiments, the operating member 58 can be omitted. Furthermore, when the unlocking handle 26 is operated to move from the first position P1 to the second position P2, each of the working members 34, 36 (such as the second working member 36) can directly drive the locking member 31 to move in order to unlock the second rail 30 relative to the first rail 28 at the predetermined position R.

Therefore, the user only needs to apply the force K to the linkage rod 38 of the unlocking handle 26 with one hand, such that the unlocking handle 26 can be moved from the first position P1 to the second position P2 in order to unlock the second rails 30 relative to the first rails 28 of the two opposite slide rail assemblies 22, 24 at the predetermined position R. It is convenient to the user since there is no need to operate with both hands. In addition, the predetermined distance M of each of the working members 34, 36 (such as the first working member 34) can be regarded as a length of a moment arm, such that a labor-saving effect can be achieved when the user applies the force K to the linkage rod 38 of the unlocking handle 26 to drive the locking member 31 to move.

Figure 7:
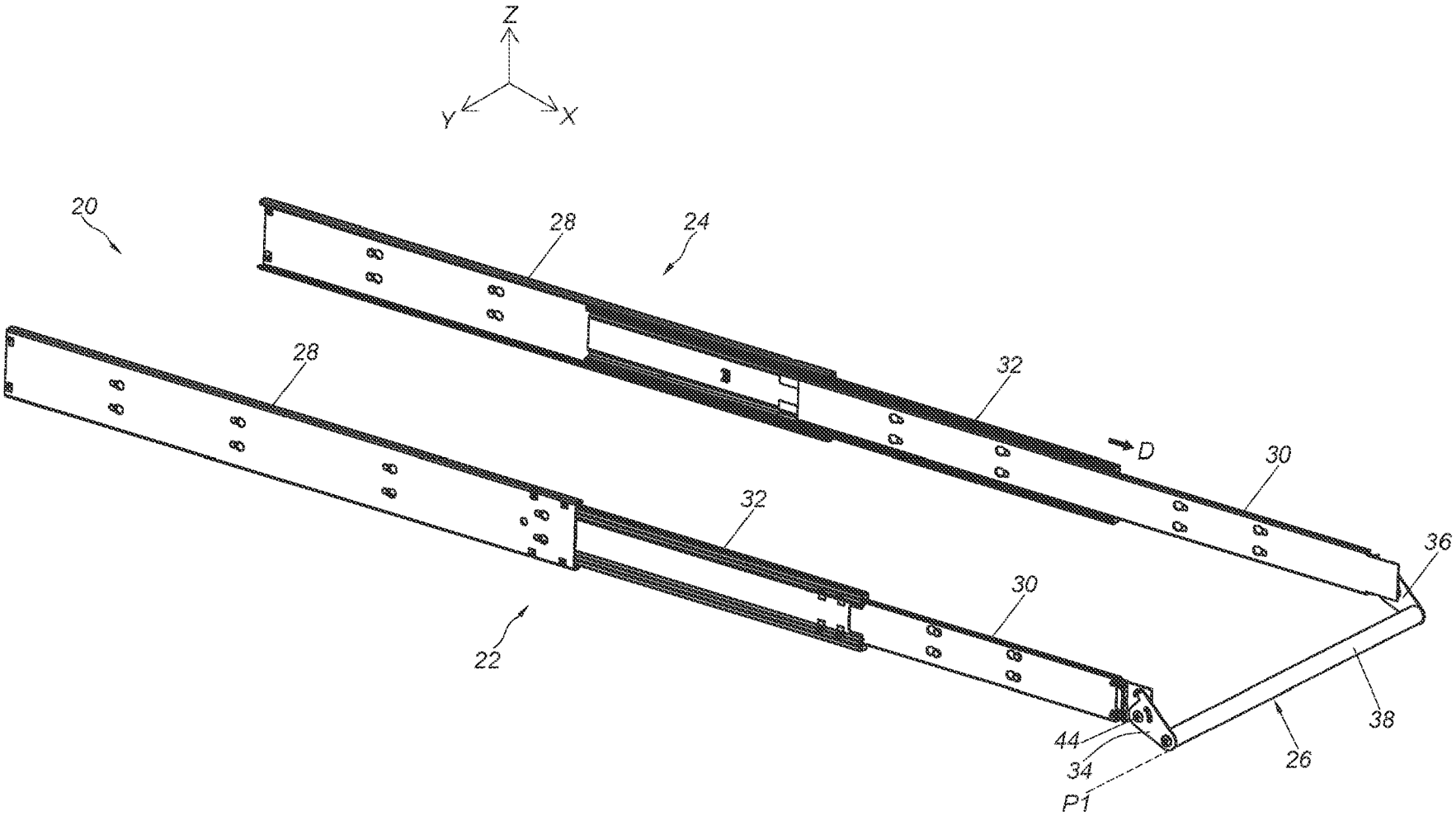
FIG. 7 is a diagram showing the slide rail assemblies of the slide rail mechanism being in an extended state according to the first embodiment of the present invention.

As shown in FIG. 7, when the locking member 31 is disengaged from the blocking structure 50 of the first rail 28, the second rail 30 can be moved away from the predetermined position R relative to the first rail 28, such that both the second rail 30 and the third rail 32 are movable relative to the first rail 28 along the direction D to make each of the slide rail assemblies 22, 24 in an extended state. When the user stops applying the force K to the linkage rod 38 of the unlocking handle 26, the two working members 34, 36 of the unlocking handle 26 return to the first position P1 (as shown in FIG. 7) from the second position P2 (please refer to FIG. 3).

Figure 8:
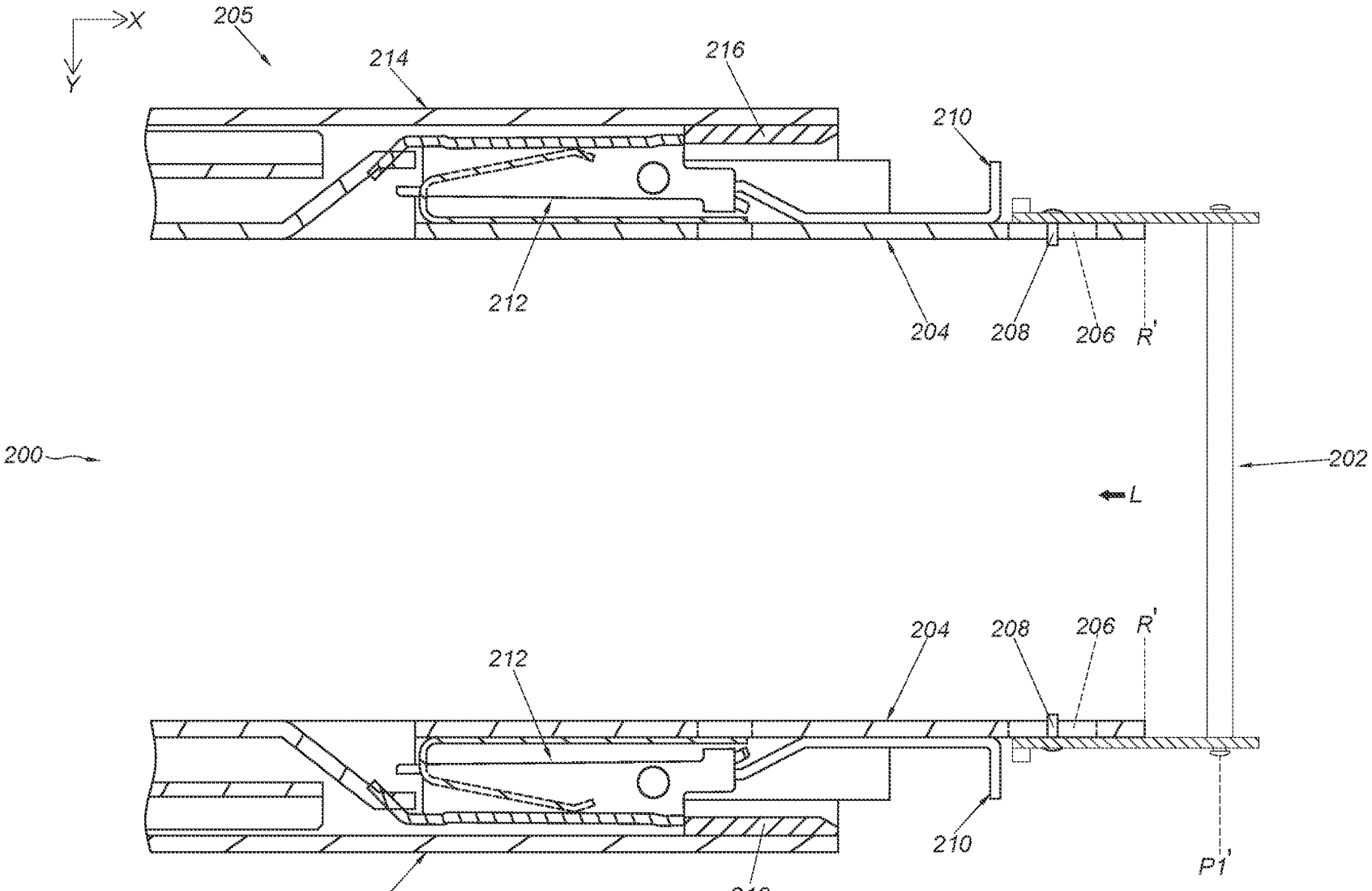
FIG. 8 is a diagram showing a slide rail mechanism with an unlocking handle being located at a first position according to a second embodiment of the present invention.
Figure 9:
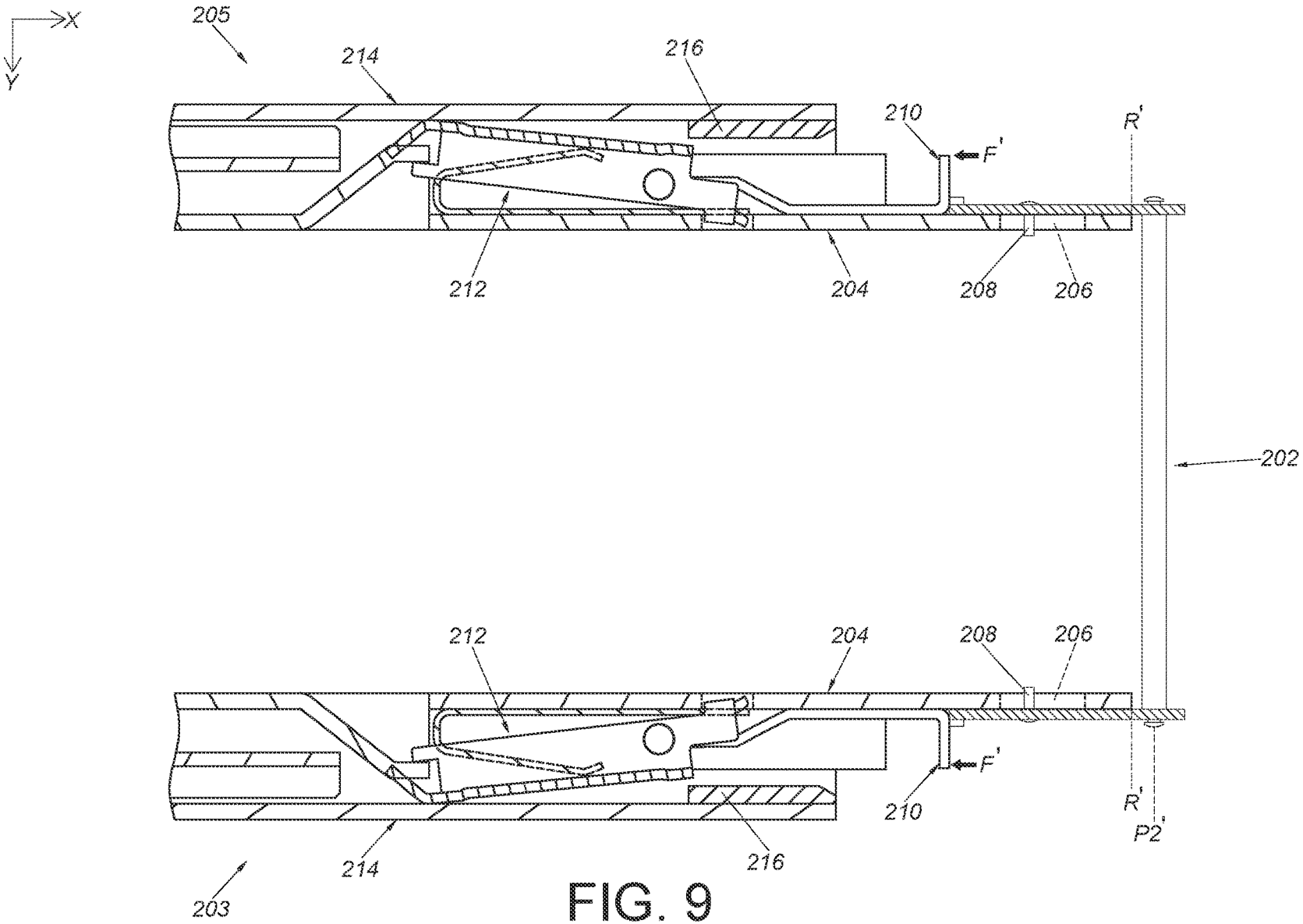
FIG. 9 is a diagram showing the slide rail mechanism with the unlocking handle being located at a second position according to the second embodiment of the present invention.

FIG. 8 and FIG. 9 are diagrams showing a slide rail mechanism 200 according to a second embodiment of the present invention. In the first embodiment, the unlocking handle 26 of the slide rail mechanism 20 is moved through rotation of the working member 34. A main difference between the second embodiment and the first embodiment is that an unlocking handle 202 of the slide rail mechanism 200 of the second embodiment can be linearly (or longitudinally) moved from a first position P1' (as shown in FIG. 8) to a second position P2' (as shown in FIG. 9).

Furthermore, one of a second rail 204 and the unlocking handle 202 of each of the slide rail assemblies (a first slide rail assembly 203 and a second slide rail assembly 205) comprises a first predetermined feature 206 (such as a longitudinal groove or a longitudinal hole), and the other one of the second rail 204 and the unlocking handle 202 comprises a second predetermined feature 208 (such as a protrusion or an object similar to the connecting member 44, which can be inserted into a portion of the longitudinal slot or longitudinal hole). Through interaction between the first predetermined feature 206 and the second predetermined feature 208, the unlocking handle 202 can be linearly moved from the first position P1' (as shown in FIG. 8) to the second position P2' (as shown in FIG. 9) along a linear direction L, so as to provide a driving force F' to drive the operating member 210 to move the locking member 212, in order to disengage the locking member 212 from a blocking structure 216 of the first rail 214 (as shown in FIG. 9), thus the second rail 204 can be moved away from the predetermined position R' relative to the first rail 214. The linear direction L is identical to a moving direction of the second rail 204. For example, both of the linear direction L and the moving direction of the second rail 204 are longitudinal directions. In other words, the linear direction L is substantially parallel to the moving direction of the second rail 204. Moreover, configuration of the locking member 212 locking the second rail 204 relative to the first rail 214 of the second embodiment is identical to that of the first embodiment. For simplification, no further illustration is provided.

Figure 10:
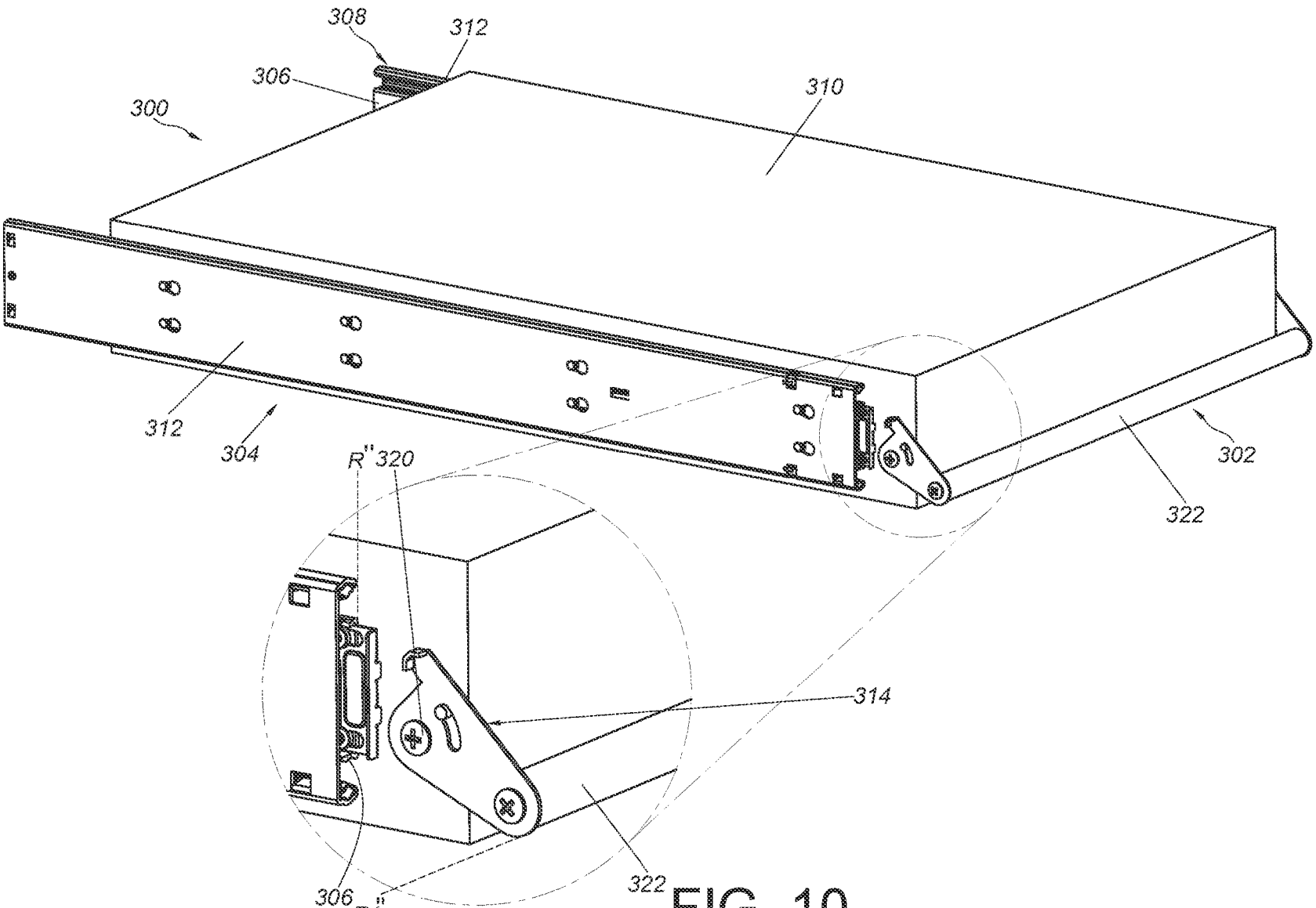
FIG. 10 is a diagram showing slide rail assemblies of a slide rail mechanism being in a retracted state according to a third embodiment of the present invention.

FIG. 10 is a diagram showing a slide rail mechanism 300 according to a third embodiment of the present invention. In the first embodiment, the unlocking handle 26 of the slide rail mechanism 20 is movably mounted between the second rail 30 of the first slide rail assembly 22 and the second rail 30 of the second slide rail assembly 24. A main difference between the third second embodiment and the first embodiment is that an unlocking handle 302 of the slide rail mechanism 300 of the third embodiment is movably mounted to a carried object 310 mounted between a second rail 306 of the first slide rail assembly 304 and a second rail 306 of the second slide rail assembly 308.

Furthermore, the first rail 312 of each of the slide rail assemblies 304, 308 can be fixed to a rack or a cabinet (not shown in figures), and the second rail 306 of each of the slide rail assemblies 304, 308 is configured to carry the carried object 310. Each of working members 314 comprises a first part and a second part. The first part is pivotally connected to the carried object 310 through a connecting member 320. The connecting member 320 can be a screw, a bolt or the like, but the present invention is not limited thereto. A linkage rod 322 is connected to the second parts of the working members 314.

According to such configuration, the user can also apply a force to drive the unlocking handle 302 to move (for example, rotate or pivot) from a first position P1" to a second position P2" in order to unlock the second rails 306 relative to the first rails 312 of the two opposite slide rail assemblies 304, 308 at a predetermined position R".

In addition to the unlocking handle 202 of the slide rail mechanism 200 of the second embodiment being mounted to a slide rail in a linearly movable manner, it is also feasible to mount the unlocking handle to a carried object mounted between the second rail of the first slide rail assembly and the second rail of the second slide rail assembly in a linearly movable manner. According to such configuration, when the unlocking handle is linearly moved from the first position to the second position relative to the second rail (or the carried object), the locking member can be driven to move in order to unlock the second rail relative to the first rail at the predetermined position.

Therefore, the slide rail mechanism and the slide rail assemblies thereof according to the embodiments of the present invention have the following technical features:

1. The unlocking handle 26 (202) can be mounted to the slide rail; or the unlocking handle 302 can be mounted to the carried object 310.

2. The user only needs to apply the force to the unlocking handle 26, 202, 302 with one hand, such that the unlocking handle 26, 202, 302 can be moved from the first position to the second position in order to unlock the second rails relative to the first rails of the two opposite slide rail assemblies at the predetermined position R. It is convenient to the user since there is no need to operate with both hands.

3. The predetermined distance M of each of the working members (such as the first working member 34) can be regarded as a length of a moment arm, such that a labor-saving effect can be achieved when the user applies the force K to the linkage rod 38 of the unlocking handle 26 to drive the locking member 31 to move.

4. The unlocking handle 26, 202 can be detachably connected between the second rail 30, 204 of the first slide rail assembly 22, 203 and the second rail 30, 204 of the second slide rail assembly 24, 205 (or the unlocking handle 302 is detachably mounted to the carried object 310 mounted between the second rail 306 of the first slide rail assembly 304 and the second rail 306 of the second slide rail assembly 308). In other words, the user can install the unlocking handle 26, 202, 302 according to requirements.

5. When the second rail 30, 204, 306 is unlocked relative to the first rail 28, 214, 312 at the predetermined position, the user can easily move the second rail 30, 204, 306 (or the carried object 310) away from the predetermined position (such as the retracted position) by pulling the unlocking handle 26, 202, 302.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A slide rail mechanism, comprising:

a first slide rail assembly and a second slide rail assembly, each of the first and second slide rail assemblies comprising a first rail and a second rail movable relative to each other, a locking member configured to lock the second rail relative to the first rail at a retracted position, and an operating member; and an unlocking handle movably mounted between the first slide rail assembly and the second slide rail assembly;

wherein when the unlocking handle is moved from a first position to a second position, the unlocking handle is configured to drive the operating member to move linearly along a longitudinal direction of the second rail to further drive the locking member to move through contact between a first feature of the operating member and a second feature of the locking member, in order to unlock the second rail relative to the first rail at the retracted position;

wherein the contact between the first feature and the second feature is a contact between two inclined portions, or a contact between an inclined portion and an arc portion.

2. The slide rail mechanism of claim 1, wherein the unlocking handle is movably mounted between the second rail of the first slide rail assembly and the second rail of the second slide rail assembly.

3. The slide rail mechanism of claim 2, wherein the unlocking handle is movably mounted on a carried object mounted between the second rail of the first slide rail assembly and the second rail of the second slide rail assembly.

4. The slide rail mechanism of claim 2, wherein the unlocking handle is detachably connected between the second rail of the first slide rail assembly and the second rail of the second slide rail assembly.

5. The slide rail mechanism of claim 2, wherein the unlocking handle comprises two working members and a linkage rod, the linkage rod is arranged between the two working members, and the two working members are rotatably connected to the second rail of the first slide rail assembly and the second rail of the second slide rail assembly respectively.

6. The slide rail mechanism of claim 5, wherein each of the working members comprises a first part and a second part, a predetermined distance is defined between the first part and the second part, the first part is pivotally connected to the second rail through a connecting member, and the linkage rod is connected to the second part.

7. The slide rail mechanism of claim 5, wherein each of the working members is arranged with a first limiting feature, and each of the second rails is arranged with a second limiting feature; wherein the two working members are configured to rotate within a limited range through interaction between the first limiting feature and the second limiting feature.

8. The slide rail mechanism of claim 6, wherein when a force is applied to the linkage rod of the unlocking handle, each of the working members of the unlocking handle is rotated from the first position to the second position in order to drive the locking member to move through the operating member; wherein the working member does not contact the operating member when the working member is located at the first position, and the working member contacts the operating member when the working member is located at the second position.

9. The slide rail mechanism of claim 5, wherein when the unlocking handle is located at the first position, the linkage rod of the unlocking handle is located at a first height relative to each of the first and second slide rail assemblies; wherein when the unlocking handle is located at the second position, the linkage rod of the unlocking handle is located at a second height different from the first height relative to each of the first and second slide rail assemblies.

10. The slide rail mechanism of claim 1, wherein the unlocking handle is configured to be linearly moved from the first position to the second position.

11. A slide rail assembly, comprising:

a first rail;

a second rail movable relative to the first rail;

a locking member configured to lock the second rail relative to the first rail at a retracted position;

an operating member; and an unlocking handle movable relative to the second rail;

wherein when the unlocking handle is moved from a first position to a second position, the unlocking handle is configured to drive the operating member to move linearly along a longitudinal direction of the second rail to further drive the locking member to move through contact between a first feature of the operating member and a second feature of the locking member, in order to unlock the second rail relative to the first rail at the retracted position, such that the second rail is able to move away from the retracted position;

wherein the contact between the first feature and the second feature is a contact between two inclined portions, or a contact between an inclined portion and an arc portion.

12. The slide rail assembly of claim 11, wherein the unlocking handle is detachably connected to the second rail.

13. The slide rail assembly of claim 11, wherein the unlocking handle comprises a working member and a linkage rod, the linkage rod is arranged on the working member, and the working member is rotatably connected to the second rail.

14. The slide rail assembly of claim 13, wherein the working member comprises a first part and a second part, a predetermined distance is defined between the first part and the second part, the first part is pivotally connected to the second rail through a connecting member, and the linkage rod is connected to the second part.

15. The slide rail assembly of claim 13, wherein the working member is arranged with a first limiting feature, and the second rail is arranged with a second limiting feature; wherein the working member is configured to rotate within a limited range through interaction between the first limiting feature and the second limiting feature.

16. The slide rail assembly of claim 14, wherein when a force is applied to the linkage rod of the unlocking handle, the working member of the unlocking handle is rotated from the first position to the second position in order to drive the locking member to move through the operating member; wherein the working member does not contact the operating member when the working member is located at the first position, and the working member contacts the operating member when the working member is located at the second position.

17. The slide rail assembly of claim 13, wherein when the unlocking handle is located at the first position, the linkage rod of the unlocking handle is located at a first height relative to the slide rail assembly; wherein when the unlocking handle is located at the second position, the linkage rod of the unlocking handle is located at a second height different from the first height relative to the slide rail assembly.

18. The slide rail assembly of claim 11, wherein the unlocking handle is configured to be linearly moved from the first position to the second position.

* * * * *